US009324275B2

(12) United States Patent
Kwak et al.

(10) Patent No.: US 9,324,275 B2
(45) Date of Patent: Apr. 26, 2016

(54) ORGANIC LIGHT EMITTING DIODE DISPLAY DEVICE AND METHOD FOR DRIVING THE SAME

(71) Applicant: LG DISPLAY CO., LTD., Seoul (KR)

(72) Inventors: Sanghyeon Kwak, Paju-si (KR); Jin-Hyun Jung, Busan (KR)

(73) Assignee: LG DISPLAY CO., LTD., Seoul (KR)

( * ) Notice: Subject to any disclaimer, the term of this patent is extended or adjusted under 35 U.S.C. 154(b) by 163 days.

(21) Appl. No.: 13/960,300

(22) Filed: Aug. 6, 2013

(65) Prior Publication Data

US 2014/0168190 A1 Jun. 19, 2014

(30) Foreign Application Priority Data

Dec. 19, 2012 (KR) ..... 10-2012-0149024

(51) Int. Cl.
*G09G 3/30* (2006.01)
*G09G 3/32* (2006.01)

(52) U.S. Cl.
CPC ..... *G09G 3/3291* (2013.01); *G09G 3/3233* (2013.01); *G09G 2300/0819* (2013.01); *G09G 2300/0866* (2013.01); *G09G 2320/043* (2013.01)

(58) Field of Classification Search
CPC ..... G09G 3/30; G09G 3/3233; G09G 3/325; G09G 3/32; G09G 3/3208; G09G 3/3216; G09G 3/3225; G09G 3/3241; G09G 3/3258; G09G 3/3266; G09G 3/3275; G09G 3/3283; G09G 3/3291; G09G 2300/0421; G09G 2300/0426; G09G 2300/043; G09G 2300/0819; G09G 2300/0866; G09G 2320/043; G02F 1/1335
USPC ..... 345/76–80; 349/69
See application file for complete search history.

(56) References Cited

U.S. PATENT DOCUMENTS

| | | | | |
|---|---|---|---|---|
| 6,380,689 | B1 | 4/2002 | Okuda | |
| 2002/0047839 | A1 * | 4/2002 | Kasai | 345/211 |
| 2004/0179005 | A1 | 9/2004 | Jo | |
| 2006/0082524 | A1 * | 4/2006 | Kwon | 345/76 |
| 2008/0165096 | A1 | 7/2008 | Chiou | |

FOREIGN PATENT DOCUMENTS

| | | | |
|---|---|---|---|
| JP | 2001-109432 | A | 4/2001 |
| JP | 2005-227310 | A | 8/2005 |

* cited by examiner

*Primary Examiner* — Lun-Yi Lao
*Assistant Examiner* — Jarurat Suteerawongsa
(74) *Attorney, Agent, or Firm* — Birch, Stewart, Kolasch & Birch, LLP

(57) ABSTRACT

Discussed is an OLED display device and a method of driving the same. The OLED display device includes first to third transistors, a capacitor, a driving transistor, and an OLED. The first transistor supplies a data voltage to a first node according to a first scan signal. A first electrode of the second transistor is connected to the first node, and a gate of the second transistor is connected to a second electrode of the second transistor. The third transistor initializes a voltage of a second node according to a second scan signal. One end of the capacitor is connected to the second node, and the other end of the capacitor is connected to a third node. A gate of the driving transistor is connected to the second node, and a source of the driving transistor is connected to the third node. The OLED emits light.

13 Claims, 9 Drawing Sheets

ORGANIC LIGHT EMITTING DIODE DISPLAY DEVICE AND METHOD FOR DRIVING THE SAME

CROSS-REFERENCE TO RELATED APPLICATIONS

This application claims the priority benefit of the Korean Patent Application No. 10-2012-0149024 filed on Dec. 19, 2012, which is hereby incorporated by reference as if fully set forth herein.

BACKGROUND

1. Field of the Invention

The present invention relates to a display device, and more particularly, to an organic light emitting diode (OLED) display device and a method of driving the same.

2. Discussion of the Related Art

With the advancement of information-oriented society, various requirements for display field are increasing, and thus, research is being done on various flat panel display devices that are thin and light, and have low power consumption. For example, the flat panel display devices are classified into liquid crystal display (LCD) devices, plasma display panel (PDP) devices, OLED display devices, etc.

Especially, OLED display devices that are being actively studied recently apply data voltage (Vdata) having various levels to respective pixels to display different grayscale levels, thereby realizing an image.

To this end, each of a plurality of pixels includes one or more capacitors, an OLED, and a driving transistor that are current control elements, wherein, a current flowing in the OLED is controlled by the driving transistor, and the amount of the current flowing in the OLED are changed by a threshold voltage deviation of the driving transistor and various parameters, causing the non-uniformity of a screen luminance.

The threshold voltage deviation of the driving transistor occurs because the characteristic of the driving transistor is changed due to a variable manufacturing process used for the driving transistor. To overcome this limitation, each pixel generally includes a compensation circuit that includes a plurality of transistors and capacitors for compensating for the threshold voltage deviation.

Recently, as consumers' requirements for high definition increase, a demand for a high-resolution OLED display device has increased. To this end, it is necessary to integrate more pixels into a unit area for high resolution, and thus, it is required to reduce the numbers of transistors, capacitors, and lines included in the compensation circuit that compensates for a threshold voltage deviation.

SUMMARY

Accordingly, the present invention is directed to providing an organic light emitting diode (OLED) display device and a method of driving the same that substantially obviate one or more problems due to limitations and disadvantages of the related art.

An aspect of the present invention is directed to providing an OLED display device that can compensate for a threshold voltage deviation and is suitable for high resolution, and a method of driving the same.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an OLED display device including: a first transistor supplying a data voltage to a first node according to a first scan signal; a second transistor, a first electrode of the second transistor being connected to the first node, and a gate of the second transistor being connected to a second electrode of the second transistor; a third transistor having a gate electrode and a source electrode connected to each other, and configured to initialize a voltage of a second node according to a second scan signal, the second node being the second electrode of the second transistor; a capacitor, one end of the capacitor being connected to the second node, and the other end of the capacitor being connected to a third node to which a high-level source voltage is applied; a driving transistor, a gate of the driving transistor being connected to the second node, and a source of the driving transistor being connected to the third node; and an OLED comprising an anode and a cathode, and emitting light with a voltage applied to the cathode, the anode being connected to a fourth node that is a drain of the driving transistor.

Moreover, in the present OLED display device, the voltage applied to the cathode is a low-level source voltage or the high-level source voltage.

Moreover, in the present OLED display device, the first transistor is turned on by the first scan signal which is applied thereto through a first scan line, and the third transistor is turned on by the second scan signal which is applied thereto through a second scan line.

Moreover, in the present OLED display device, when the first transistor is turned off and the third transistor is turned on, the voltage of the second node is initialized to a sum of a low-level voltage of the second scan signal and an absolute threshold value of the third transistor.

Moreover, in the present OLED display device, when the first transistor is turned on and the third transistor is turned off, an nth data voltage of a plurality of the data voltages is applied to the first node, and the voltage of the second node increases up to a difference voltage between the nth data voltage and an absolute threshold voltage of the second transistor.

Moreover, in the present OLED display device, when the first and third transistors are turned off and a high-level source voltage is applied to the cathode, data voltages subsequent to an nth data voltage among a plurality of the data voltages are continuously applied to the source of the first transistor.

Moreover, in the present OLED display device, when the first and third transistors are turned off and a low-level source voltage is applied to the cathode, the OLED emits light.

Moreover, in the present OLED display device, a threshold voltage of the second transistor is equal to a threshold voltage of the driving transistor.

Moreover, in the present OLED display device, the first and second scan signals are an nth scan signal and an n−1th scan signal of a plurality of scan signals, respectively.

In another aspect of the present invention, there is provided a method of driving an OLED display device, which includes first to third transistors, a driving transistor, a capacitor, and an OLED, including: initializing a voltage of a second node that is a second electrode of the second transistor according to a second scan signal applied to a gate of the third transistor, when the first transistor is turned off and the third transistor is turned on; applying an nth data voltage of a plurality of data voltages to a first node that is a first electrode of the second transistor, and increasing the voltage of the second node up to a difference voltage between the nth data voltage and an absolute threshold voltage of the second transistor, when the first transistor is turned on and the third transistor is turned off; and emitting light when the first and third transistors are turned off and a low-level source voltage is applied to a cathode of the OLED.

Moreover, in the method of driving an OLED display device, the initializing of a voltage comprises initializing the voltage of the second node to a sum of a low-level voltage of the second scan signal and an absolute threshold value of the third transistor.

Moreover, the method of driving an OLED display device further comprising continuously applying data voltages subsequent to an nth data voltage among a plurality of the data voltages to a source of the first transistor, when the first and third transistors are turned off and a high-level source voltage is applied to the cathode.

Moreover, in the method of driving an OLED display device, the first transistor is turned on by a first scan signal which is applied thereto through a first scan line, and the third transistor is turned on by the second scan signal which is applied thereto through a second scan line.

Moreover, in the method of driving an OLED display device, the first and second scan signals are an nth scan signal and an n−1th scan signal of a plurality of scan signals, respectively.

Moreover, in the method of driving an OLED display device, a threshold voltage of the second transistor is equal to a threshold voltage of the driving transistor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
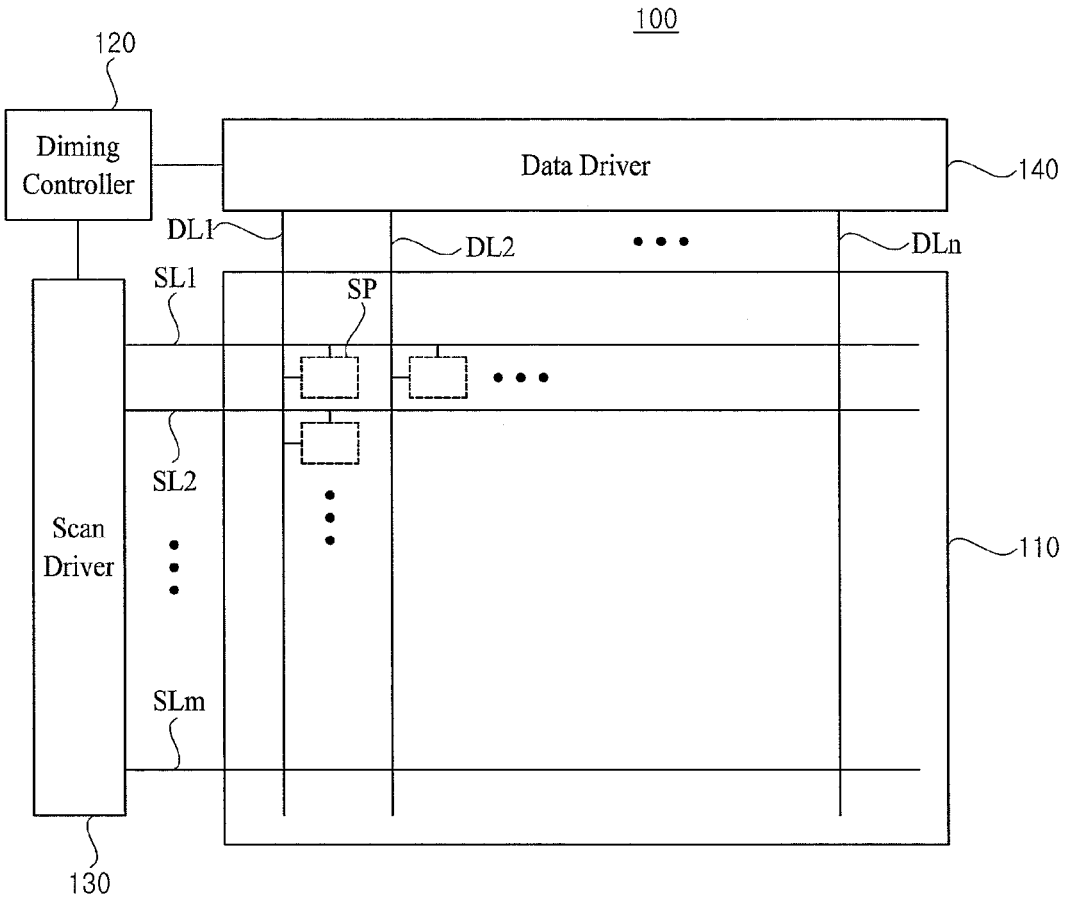
FIG. 1 is a diagram schematically illustrating a configuration of an OLED display device according to embodiments of the present invention.

FIG. 1 is a diagram schematically illustrating a configuration of an OLED display device according to embodiments of the present invention.

As illustrated in FIG. 1, an OLED display device 100 according to embodiments of the present invention includes a panel 110, a timing controller 120, a scan driver 130, and a data driver 140.

The panel 110 includes a plurality of sub-pixels SP that are arranged in a matrix type. The sub-pixels SP included in the panel 110 emit light according to respective scan signals which are supplied through a plurality of scan lines SL1 to SLm from the scan driver 120 and respective data signals (data voltages) that are supplied through a plurality of data lines DL1 to DLn from the data driver 130.

To this end, one sub-pixel includes an OLED, and a plurality of transistors and capacitors for driving the OLED.

The timing controller 120 receives a vertical sync signal Vsync, a horizontal sync signal Hsync, a data enable signal DE, a clock signal CLK, and video signals from the outside. Also, the timing controller 120 aligns external input video signals to digital image data RGB in units of a frame.

For example, the timing controller 120 controls the operational timing of each of the scan driver 130 and the data driver 140 with timing signals that include the vertical sync signal Vsync, the horizontal sync signal Hsync, the data enable signal DE, and the clock signal CLK. To this end, the timing controller 120 generates a gate control signal GCS for controlling the operational timing of the scan driver 130 and a data control signal DCS for controlling the operational timing of the data driver 140.

The scan driver 130 generates a scan signal "Scan" that enables the operations of transistors included in each of the sub-pixels SP in the panel 110, according to the gate control signal GCS supplied from the timing controller 120, and supplies the scan signal "Scan" to the panel 110 through the scan lines SL1-SLm. Hereinafter, a scan signal applied through an nth scan line of the scan lines is referred to as a first scan signal Scan[n], and a scan signal applied through an n−1th scan line of the scan lines is referred to as a second scan signal Scan[n−1].

The data driver 140 generates data signals from the digital image data RGB and the data control signal DCS that are supplied from the timing controller 120, and supplies the generated data signals to the panel 110 through the respective data lines DL1-DLn.

Hereinafter, the detailed configuration of each sub-pixel will be described in detail with reference to FIGS. 1 and 2.

Figure 2:
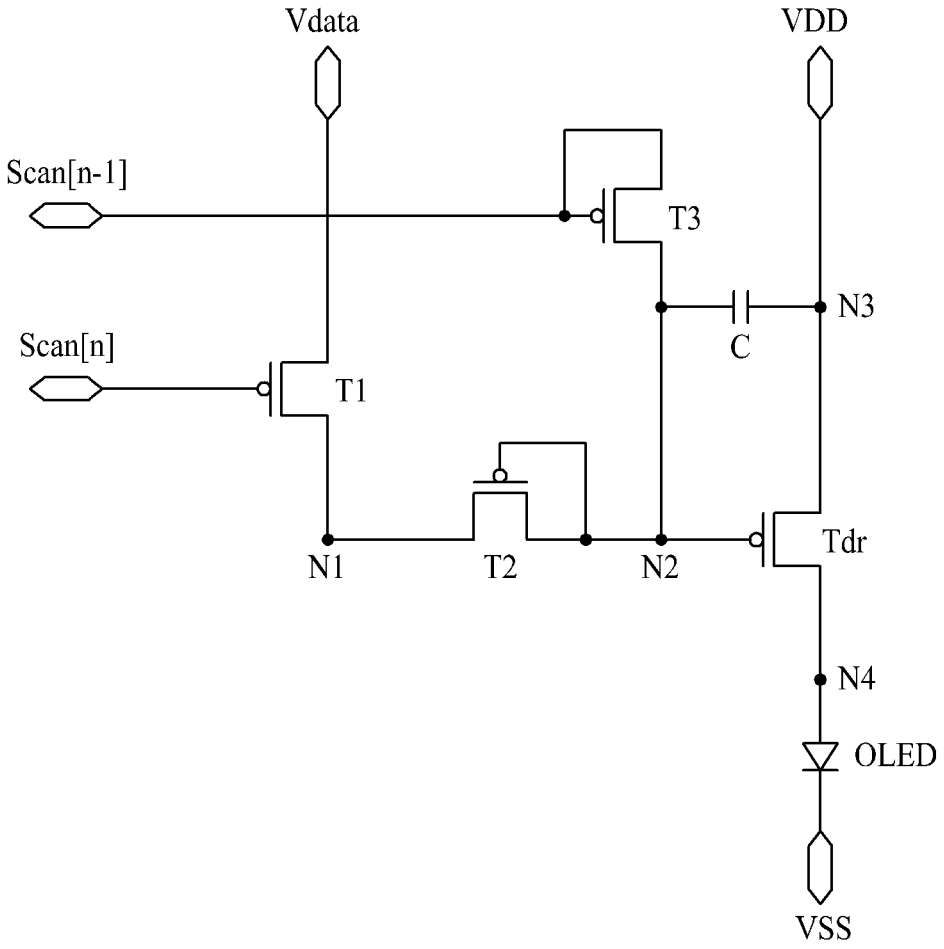
FIG. 2 is a diagram schematically illustrating an equivalent circuit of a sub-pixel of FIG. 1.

FIG. 2 is a diagram schematically illustrating an equivalent circuit of a sub-pixel of FIG. 1.

As illustrated in FIG. 2, each sub-pixel SP may include first to third transistors T1 to T3, a driving transistor Tdr, a capacitor C, and an OLED.

The first to third transistors T1 to T3 and the driving transistor Tdr, as illustrated in FIG. 2, are PMOS transistors, but are not limited thereto. As another example, an NMOS transistor may be applied thereto, in which case a voltage for turning on the PMOS transistor has a polarity opposite to that of a voltage for turning on the NMOS transistor.

First, a second scan signal Scan[n−1] is applied to a gate of the third transistor T3, the gate of the third transistor T3 is connected to a source of the third transistor T3, and a drain of the third transistor T3 is connected to a second node N2 which is also one end of the capacitor C.

For example, the second scan signal Scan[n−1] may be applied to the gate of the third transistor T3 through a second scan line, and an operation of the third transistor may be controlled according to the scan signal.

Therefore, the third transistor T3 may be turned on according to the second scan signal Scan[n−1], a voltage of the second node N2 corresponding to the drain of the third transistor T3 and the one end of the capacitor C may be initialized to the sum "VGL+|Vth3|" of an absolute value "|Vth3|" of a threshold voltage "Vth3" of the third transistor T3 and a low-level voltage VGL of the second scan signal Scan[n−1].

Here, since the gate and source of the third transistor T3 are connected, the third transistor T3 may have a diode connection, and thus, the voltage of the second node N2 may be initialized to a voltage greater than the low-level voltage VGL (which is a source voltage of the third transistor T3) of the second scan signal by the absolute value "|Vth3|" of the threshold voltage of the third transistor T3.

Subsequently, a first scan signal Scan[n] is applied to a gate of the first transistor T1, a data voltage Vdata is applied to a source of the first transistor T1, and a drain of the first transistor T1 is connected to a first node N1 which is a drain of the second transistor T2.

For example, when the data voltage Vdata is applied to the source of the first transistor T1 through a data line DL and thus the first transistor T1 is turned on by the first scan signal Scan[n] applied through a first scan line, the data voltage Vdata is applied to the first node N1.

Here, the data voltage Vdata may be a signal which is changed periodically. For example, a plurality of the data voltages Vdata may be different successive voltages which are applied in a unit of one horizontal period (1H). For example, when an n−1th data voltage Vdata[n−1] is applied to the source of the first transistor T1 during one horizontal period (1H), an nth data voltage Vdata[n] is applied to the source of the first transistor T1 during the next one horizontal period (1H), and in succession, successive data voltages may be applied to the source of the first transistor T1 in a unit of one horizontal period (1H).

A drain of a second transistor T2 is connected to the first node N1, a gate of the second transistor T2 is connected to a second node N2 that is a source of the second transistor T2, and the second node N2 is connected to a gate of the driving transistor Tdr.

For example, when the data voltage Vdata is applied to the first node N1, a voltage of the second node N2 which is a voltage at the gate of the driving transistor Tdr may increase up to a voltage "Vdata−|Vth2|", which is a difference voltage between the data voltage Vdata and an absolute voltage "|Vth2|" of a threshold voltage "Vth2" of the second transistor T2.

Here, since the gate of the second transistor T2 is connected to the source of the second transistor T2 which is connected to the second node N2, the second transistor T2 has a diode connection. Therefore, the voltage of the second node N2 is initialized to the sum "VGL+|Vth3|" of the absolute value "|Vth3|" of the threshold voltage "Vth3" of the third transistor T3 and the low-level voltage VGL of the second scan signal, and then, the voltage of the second node N2 may increase to a voltage less than a data voltage (which is a voltage at the drain of the second transistor T2) by the absolute voltage "|Vth2|" of the threshold voltage "Vth2" of the second transistor T2.

Here, the threshold voltage "Vth2" of the second transistor T2 may be equal to the threshold voltage "Vth" of the driving transistor Tdr. Therefore, the capacitor C which will be described later may sense the threshold voltage "Vth2" of the second transistor T2, and thus simultaneously sense the threshold voltage "Vth" of the driving transistor Tdr.

The one end of the capacitor C is connected to the second node N2, and the other end is connected to a third node N3 receiving a high-level source voltage VDD.

For example, by sensing the threshold voltage of the second transistor T2, the capacitor C may sense the threshold voltage of the driving transistor Tdr and sample a data voltage. Specifically, the capacitor C may store a voltage "VDD−Vdata+|Vth2|" less than the high-level source voltage VDD by a difference voltage "Vdata−|Vth2|" between the data voltage Vdata and the absolute voltage "|Vth2|" of the threshold voltage "Vth2" of the second transistor T2.

The gate of the driving transistor Tdr is connected to the second node N2, a source of the driving transistor Tdr is connected to the third node N3, and a drain of the driving transistor Tdr is connected to a fourth node N4.

The amount of a current flowing in the organic light emitting diode (OLED) which will be described later may be decided by the sum "Vsg+Vth" of a source-gate voltage "Vsg" of the driving transistor Tdr and the threshold voltage "Vth" of the driving transistor Tdr, and finally be decided by a compensation circuit with the data voltage Vdata and the high-level source voltage VDD.

Therefore, since the amount of a current flowing in the OLED is proportional to the level of the data voltage Vdata, the OLED display device according to embodiments of the present invention applies various levels of data voltages Vdata to respective sub-pixels SP to realize different gray scales, thereby displaying an image.

An anode of the OLED is connected to the fourth node N4, and a cathode of the OLED receives a low-level source voltage VSS or the high-level source voltage VDD applied to the third node N3.

For example, when the high-level source voltage VDD is applied to the cathode of the OLED, the OLED may be turned off, and when the low-level source voltage VSS is applied to the cathode of the OLED, the OLED may be turned on and thus emit light. Accordingly, the emission of the OLED may be controlled according to a voltage applied to the cathode.

Hereinafter, the operation of each sub-pixel included in the OLED display device according to embodiments of the present invention will be described in detail with reference to FIGS. 3 and 5A to 5D.

Figure 3:
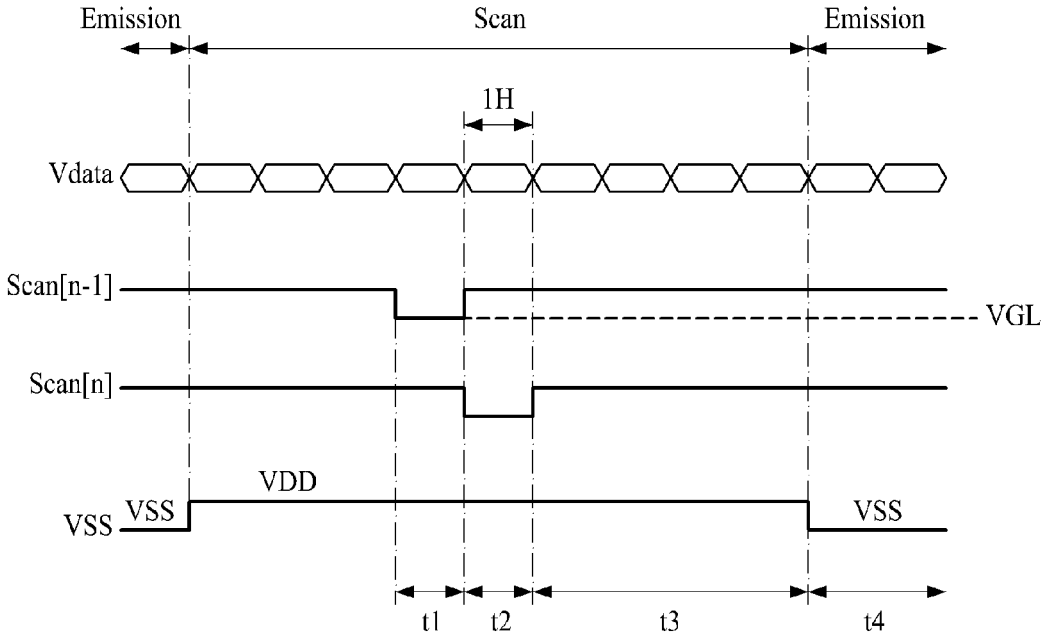
FIG. 3 is a timing chart for control signals supplied to the equivalent circuit of FIG. 2.

FIG. 3 is a timing chart for control signals supplied to the equivalent circuit of FIG. 2. FIGS. 5A to 5D are diagrams showing a method of driving an OLED display device according to embodiments of the present invention.

As illustrated in FIG. 3, the OLED display device according to embodiments of the present invention operates during a scan period or an emission period. The scan period may include an initialization period t1, a sampling period t2, and a holding period t3.

First, as shown in FIG. 3, during the initialization period t1, the first scan signal Scan[n] having a high level and the second scan signal Scan[n−1] having a low level are applied to a sub-pixel, and the high-level source voltage VDD is applied to the cathode of the OLED.

Figure 5A:
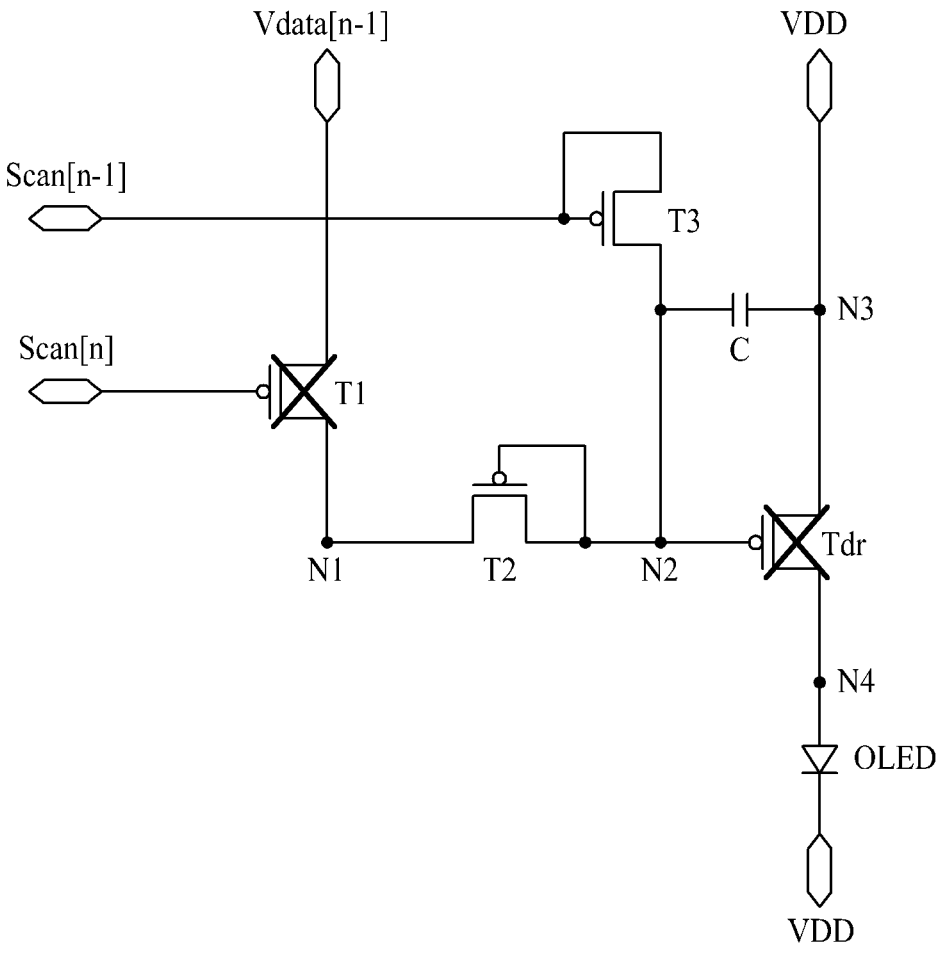
FIGS. 5A to 5D are diagrams showing a method of driving an OLED display device according to embodiments of the present invention.

Therefore, as illustrated in FIG. 5A, the first transistor T1 is turned off by the first scan signal Scan[n] having a high level, and the third transistor T3 is turned on by the second scan signal Scan[n−1] having a low level. Also, an n−1th data voltage Vdata[n−1] is applied to the source of the first transistor T1 through a data line, but, since the first transistor T1 is turned off by the first scan signal Scan[n] having a high level, the voltage of the first node N1 is not changed. Also, the high-level source voltage VDD is applied to the cathode of the OLED, and thus, the driving transistor and the OLED are turned off.

For example, during the initialization period t1, the OLED may be turned off by the high-level source voltage VDD applied to the cathode thereof, and the gate and source of the third transistor T3 may be connected, whereby the voltage of the second node N2 may be initialized to a voltage "VGL+|Vth3|" greater than the low-level voltage VGL (which is the source voltage of the third transistor T3) of the second scan signal by the absolute value "|Vth3|" of the threshold voltage "Vth3" of the third transistor T3.

As a result, during the initialization period t1, the OLED emits light with a voltage applied to the cathode thereof, and the voltage of the second node N2 is initialized to the sum "VGL+|Vth3|" of the absolute value "|Vth3|" of the threshold voltage "Vth3" of the third transistor T3 and the low-level voltage VGL of the second scan signal by the diode connection of the third transistor T3.

Subsequently, as shown in FIG. 3, during the sampling period t2, the first scan signal Scan[n] having a low level and the second scan signal Scan[n−1] having a high level are applied to the sub-pixel, and the high-level source voltage VDD is applied to the cathode of the OLED.

Figure 5B:
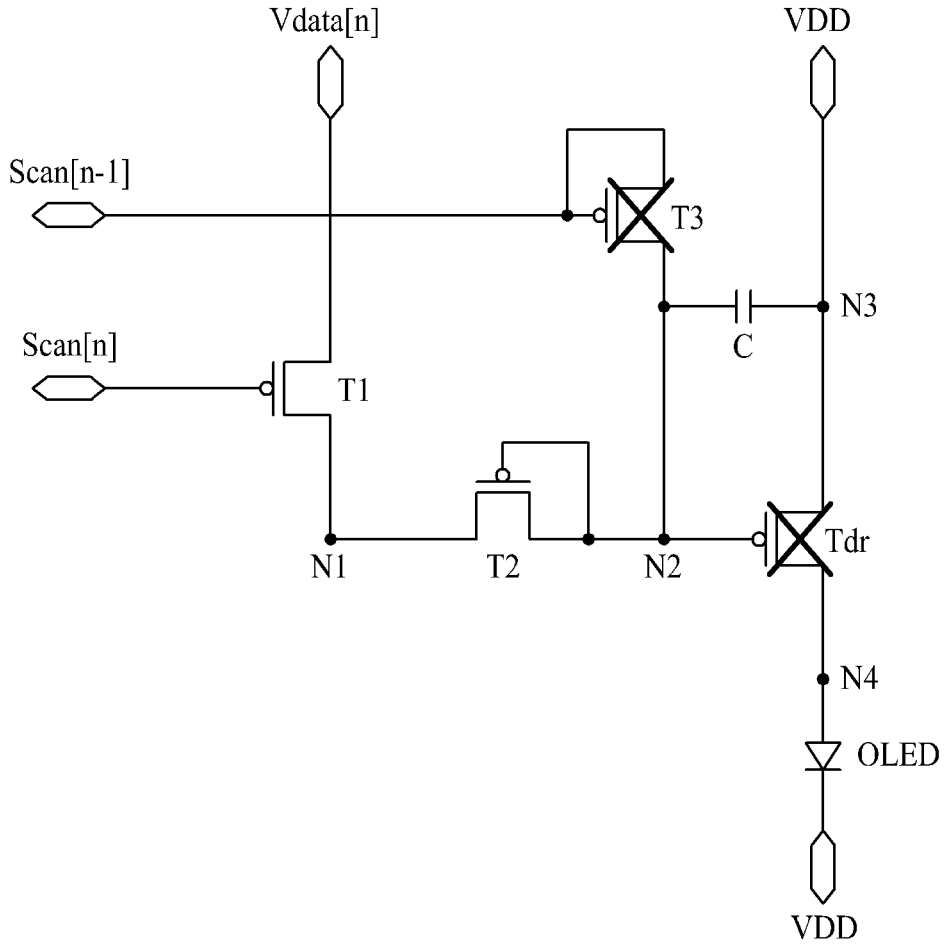

Therefore, as illustrated in FIG. 5B, the first transistor T1 is turned on by the first scan signal Scan[n] having a low level, and the third transistor T3 is turned off by the second scan signal Scan[n−1] having a high level. Also, an nth data voltage Vdata[n] is applied to the source of the first transistor T1 through the data line. Also, the high-level source voltage VDD is applied to the cathode of the OLED, and thus, the driving transistor Tdr and the OLED maintain a turn-off state.

For example, during the sampling period t2, as the first transistor T1 is turned on and the third transistor T3 is turned off, the voltage of the second node N2 may be increased up to the difference voltage "Vdata−|Vth2|" between the data voltage Vdata and the absolute voltage "|Vth2|" of the threshold voltage "Vth2" of the second transistor T2 by the diode connection of the second transistor T2. Therefore, the capacitor C may store the voltage "VDD−Vdata−|Vth2|" less than the high-level source voltage VDD by a difference voltage "Vdata[n]−|Vth2|" between the nth data voltage Vdata[n] and the absolute voltage "|Vth2|" of the threshold voltage "Vth2" of the second transistor T2.

As a result, during the sampling period t2, the capacitor C samples the nth data voltage Vdata[n], and, since the threshold voltage "Vth2" of the second transistor T2 is equal to the threshold voltage "Vth" of the driving transistor Tdr, by sensing the threshold voltage "Vth2" of the second transistor T2, the capacitor C senses the threshold voltage "Vth" of the driving transistor Tdr. Also, during the sampling period t2, since the high-level source voltage VDD is applied to the cathode of the OLED, the driving transistor Tdr and the OLED maintain a turn-off state.

Subsequently, as shown in FIG. 3, during the holding period t3, the first and second scan signals Scan[n] and Scan[n−1] having a high level are applied to a sub-pixel, and the high-level source voltage VDD is applied to the cathode of the OLED.

Figure 5C:
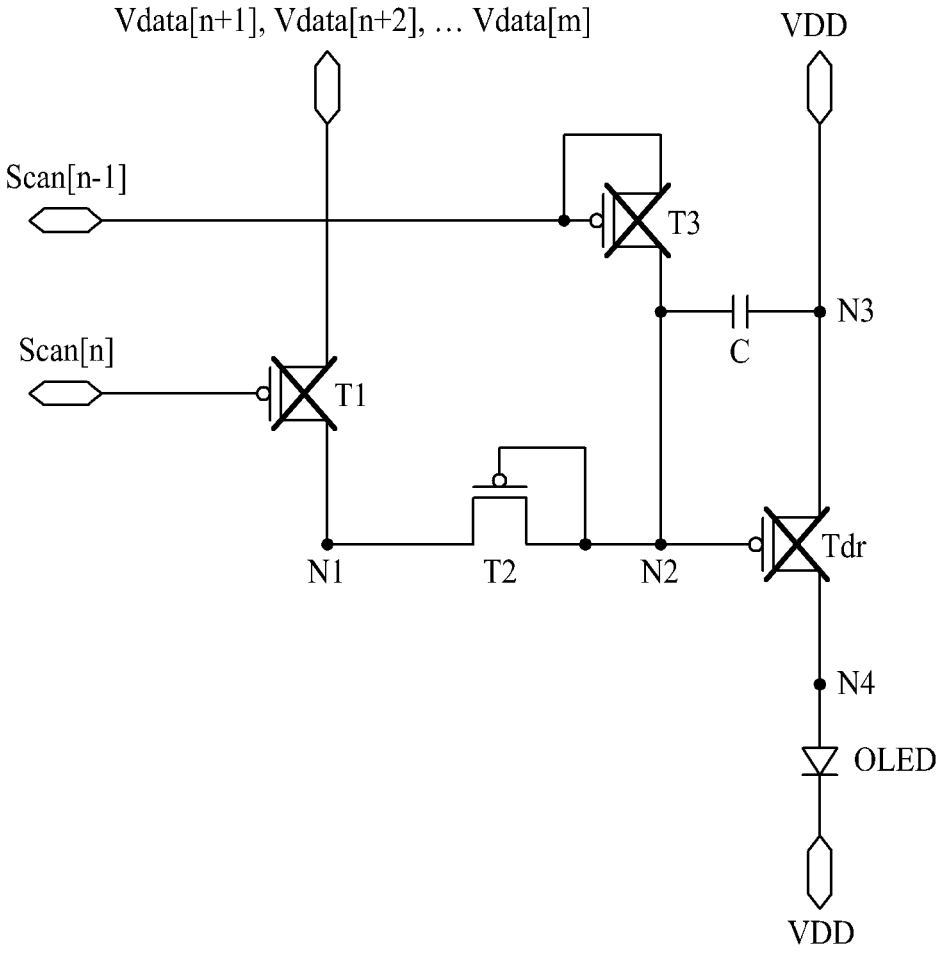

Therefore, as illustrated in FIG. 5C, the first transistor T1 is turned off by the first scan signal Scan[n] having a high level, and the third transistor T3 is turned off by the second scan signal Scan[n] having a high level. Also, the data voltages "Vdata[n+1], Vdata[n+2], . . . Vdata[m]" subsequent to the nth data voltage Vdata[n] are continuously applied to the source of the first transistor T1 through the data line, but, since the first transistor T is turned off by the first scan signal Scan[n] having a high level, the voltage of the first node N1 is not changed. Also, the high-level source voltage VDD is applied to the cathode of the OLED, and thus, the driving transistor Tdr and the OLED maintain a turn-off state.

For example, during the holding period t3, as the first and third transistors T1 and T3 are turned off, the voltage "VDD−Vdata[n]+|Vth2|" which has been stored in the capacitor C during the sampling period t2 may be maintained continuously, and, as the high-level source voltage VDD is applied to the cathode of the OLED, the driving transistor Tdr and the OLED may maintain in a turn-off state.

As a result, during the holding period t3, as the first and third transistors T1 and T3 are turned off, the data voltages "Vdata[n+1], Vdata[n+2], . . . Vdata[m]" subsequent to the nth data voltage Vdata[n] are continuously applied to the source of the first transistor T1 through the data line, but, the voltage "VDD−Vdata[n]+|Vth2|" which has been stored in the capacitor C during the sampling period t2 may be maintained continuously. Also, by applying the high-level source voltage VDD to the OLED until sampling of the mth data voltage Vdata[m] is completed, the OLED maintains a turn-off state.

Each OLED included in the OLED display device according to embodiments of the present invention does not emit light after sampling of a corresponding scan line is completed in each frame but maintains the holding period until sampling of the all scan lines is sequentially completed, and then, after sampling of the all scan lines is completed, the OLED starts to emit light.

An operation in which all the scan lines are scanned and then all OLEDs emit light at one time will be described below in more detail with reference to FIG. 4.

Figure 4:
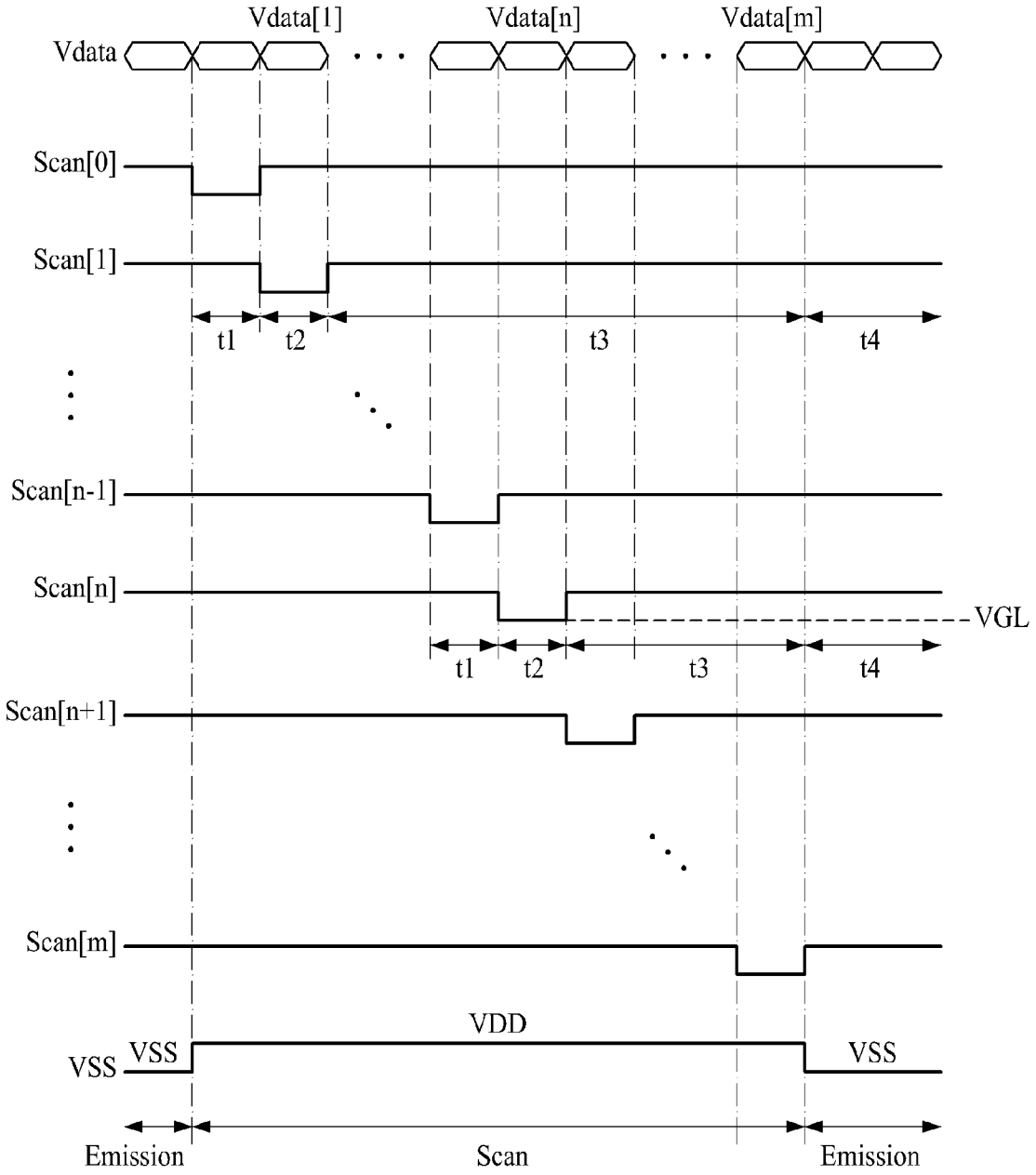
FIG. 4 is a timing chart showing in detail the timing chart of FIG. 3.

FIG. 4 is a timing chart showing in detail the timing chart of FIG. 3. In the OLED display device according to embodiments of the present invention, when it is assumed that there are 'm' scan lines, wherein 'm' is an integral number greater than 1, scan signals Scan[1], Scan[n] and Scan[m] are respectively applied to a 1st scan line, an nth scan line, and an mth scan line, and 1st to mth data voltages Vdata[1] to Vdata[m] are applied to one data line intersecting each scan line.

Here, a scan period in which a plurality of data voltages are applied to respective sub-pixels may include an initialization period, a sampling period, and a holding period for each scan line.

Therefore, the holding period is maintained after sampling of a corresponding data voltage (a sampling period t2) is performed for each scan line, and then, after sampling of the mth data voltage Vdata[m] is completed, finally, by simultaneously applying the low-level source voltage VSS to respective cathodes of OLEDs connected to each scan line, the OLEDs connected to each scan line simultaneously starts to emit light.

Subsequently, as shown in FIG. 3, during an emission period t4, the first and second scan signals Scan[n] and Scan[n−1] having a high level are applied to a sub-pixel, and the low-level source voltage VSS is applied to the cathode of the OLED.

Figure 5D:
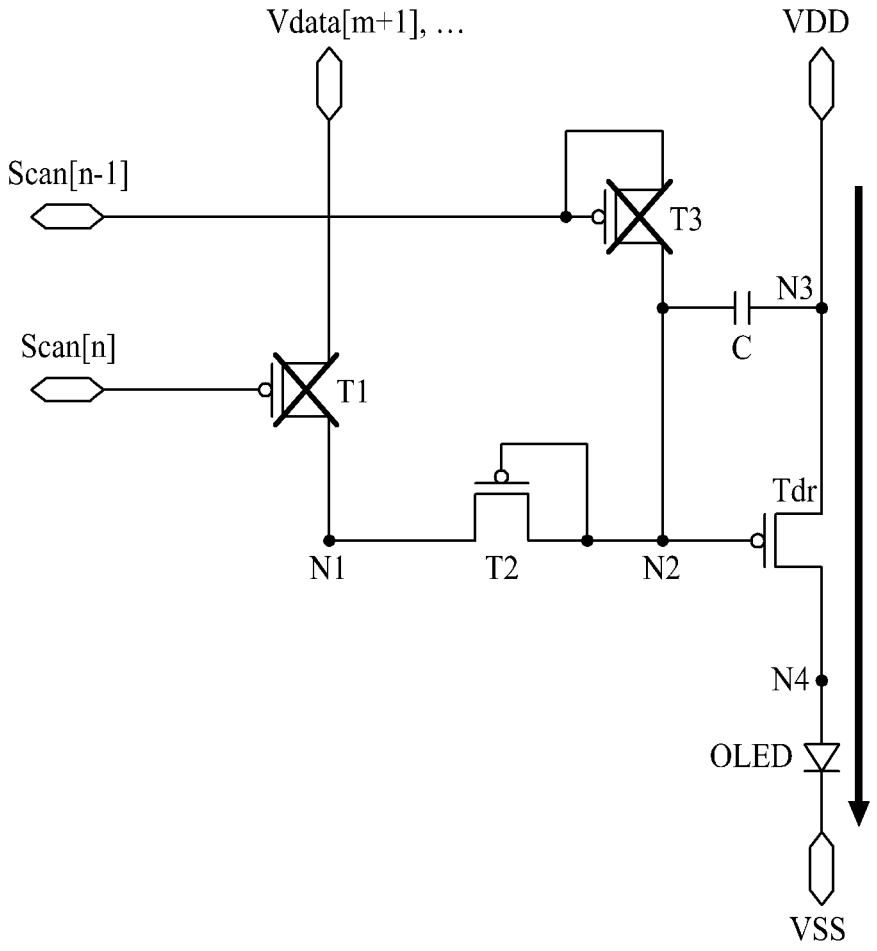

Thus, as illustrated in FIG. 5D, the first and third transistors T1 and T3 are maintained in a turn-off state by the first and second scan signals Scan[n] and Scan[n−1] having a high level. Also, arbitrary data voltages "Vdata[m+1], . . . " are continuously applied to the source of the first transistor T1 through the data line, but, since the first transistor T1 is turned off by the first scan signal Scan[n] having a high level, the voltage of the first node N1 is not changed. Also, since the low-level source voltage VSS is applied to the cathode of the OLED, the driving transistor Tdr is turned on, and the OLED starts to emit light.

Accordingly, the current Ioled flowing in the OLED may be decided by a current flowing in the driving transistor Tdr, and the current flowing in the driving transistor Tdr may be decided by the gate-source voltage (Vgs) of the driving transistor Tdr and the threshold voltage (Vth) of the driving transistor Tdr. The current Ioled may be defined as expressed in Equation (1). Also, the voltage "VDD−Vdata[n]+|Vth2|" which has been stored in the capacitor C during the sampling period t2 may be maintained without any change during the holding period t3, and thus, the voltage of the gate (which is the second node N2) of the driving transistor Tdr may become a voltage "Vdata[n]−|Vth2|".

$$\begin{aligned} Ioled &= K \times (Vgs - Vth)^2 \quad (1) \\ &= K \times (Vsg - Vth)^2 \\ &= K \times (VDD - Vdata[n] + |Vth2| + Vth)^2 \\ &= K \times (VDD - Vdata[n] + |Vth2| - |Vth|)^2 \\ &= K \times (VDD - Vdata[n])^2 \end{aligned}$$

where K denotes a proportional constant that is determined by the structure and physical properties of the driving transistor Tdr, and may be determined according to the mobility of the driving transistor Tdr and the ratio "W/L" of the channel width "W" and length "L" of the driving transistor Tdr. Also, when the transistors included in the OLED are PMOS transistors, the threshold voltage of each of the transistors has a negative value, and, as described above, the threshold voltage "Vth2" of the second transistor T2 is equal to the threshold voltage "Vth" of the driving transistor. The threshold voltage "Vth" of the driving transistor Tdr does not always have a constant value, and the deviation of the threshold voltage "Vth" occurs according to the operational state of the driving transistor Tdr.

Referring to Equation (1), in the OLED display device according to embodiments of the present invention, since the threshold voltage "Vth2" of the second transistor T2 is equal to the threshold voltage "Vth" of the driving transistor, the current Ioled flowing in the OLED is not affected by the threshold voltage "Vth" of the driving transistor Tdr during the emission period t4, and may be decided by a difference between the high-level source voltage VDD and the data voltage Vdata.

Accordingly, the OLED display device compensates for a threshold voltage deviation due to the operational state of the driving transistor Tdr, and thus maintains a constant current flowing in the OLED, thereby preventing the degradation of image quality.

Moreover, in the OLED display device according to embodiments of the present invention, the number of transistors and capacitors included in the compensation circuit is relatively small, while a control signal is not applied to the gate of the third transistor T3 through a separate control line, and the second scan signal Scan[n−1] which is a scan signal prior to the first scan signal Scan[n] applied through the first scan line is applied to the gate of the third transistor T3 through the second scan line. Accordingly, the present invention can decrease the layout area of the panel without designing the separate lines, and thus, the OLED display device according to embodiments of the present invention is suitable for high resolution.

Figure 6:
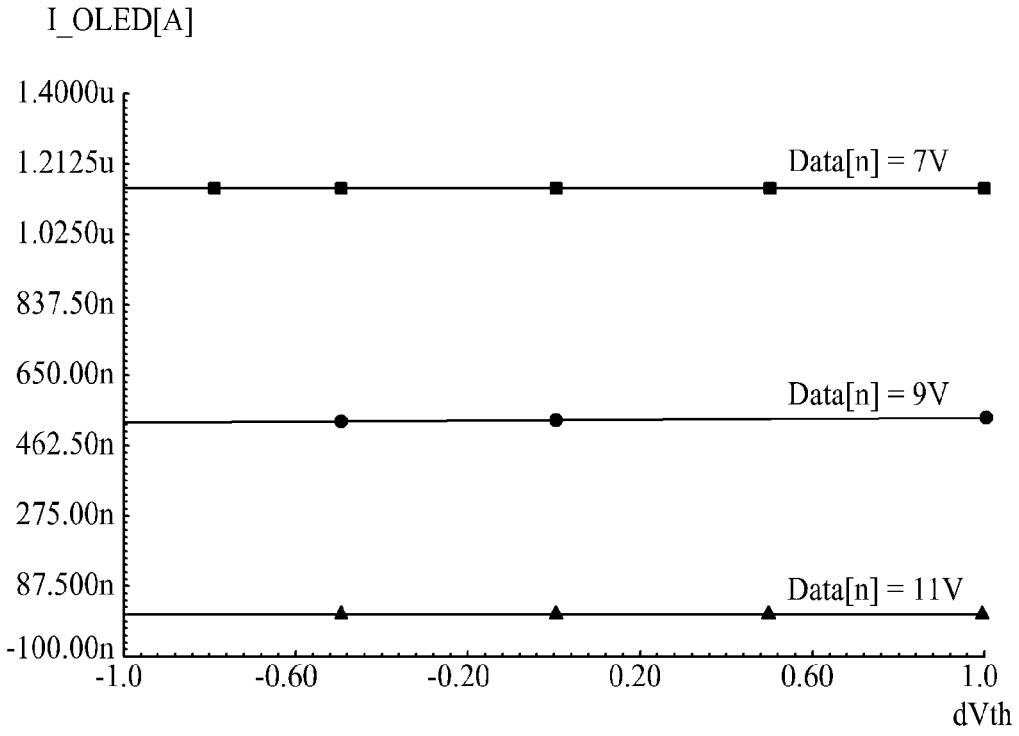
FIG. 6 is a diagram showing a change in a current due to a threshold voltage deviation of the OLED display device according to embodiments of the present invention.

FIG. 6 is a diagram showing a change in a current due to a threshold voltage deviation of the OLED display device according to embodiments of the present invention.

As show in FIG. 6, it can be seen that the level of the current Ioled flowing in the OLED is proportional to the data voltage Vdata, but a constant level of the current Ioled is maintained under the same data voltage Vdata regardless of a threshold voltage deviation "dVth".

According to the embodiments of the present invention, the OLED display device compensates for the threshold voltage deviation due to the operational state of the driving transistor, and therefore maintains a constant current flowing in each OLED, thus preventing the degradation of image quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode (OLED) display device, comprising:

a plurality of sub-pixels disposed in a display panel, wherein each of the plurality of subpixels comprises:

a first transistor supplying a data voltage to a first node according to a first scan signal, a second transistor, a first electrode of the second transistor being connected to the first node, and a gate of the second transistor being connected to a second electrode of the second transistor, a third transistor having a gate electrode and a source electrode connected to each other, and configured to initialize a voltage of a second node according to a second scan signal, the second node being the second electrode of the second transistor, a capacitor, one end of the capacitor being connected to the second node, and the other end of the capacitor being connected to a third node to which a high-level source voltage is applied, a driving transistor, a gate of the driving transistor being connected to the second node, and a source of the driving transistor being connected to the third node; and an OLED comprising an anode and a cathode, and emitting light with a voltage applied to the cathode, the anode being connected to a fourth node that is a drain of the driving transistor: and a timing controller configured to:

divide a frame period into a scan period and an emission period, wherein the scan period includes an initialization period, a sampling period and a holding period, during the scan period, sequentially supply, to each sub-pixel in the plurality of sub-pixels, a high-level voltage for the first scan signal and a low-level voltage for the second scan signal during the initialization period, the low-level voltage for the first scan signal and the high-level voltage for the second scan signal during the sampling period, and the high-level voltage for the first scan signal and the high-level voltage for the second scan signal during the holding period, wherein a high-level source voltage is supplied to the cathode electrode in each of the OLEDs respectively included in the plurality of sub-pixels and the OLEDs not emitting light during the scan period, and wherein a low-level source voltage is supplied to the cathode electrode in each of the OLEDs respectively included in the plurality of sub-pixels and the OLEDs simultaneously emitting light during the emission period.

2. The OLED display device of claim 1, wherein, the first transistor is turned on by the first scan signal which is applied thereto through a first scan line, and the third transistor is turned on by the second scan signal which is applied thereto through a second scan line.

3. The OLED display device of claim 1, wherein when the first transistor is turned off and the third transistor is turned on, the voltage of the second node is initialized to a sum of a low-level voltage of the second scan signal and an absolute threshold value of the third transistor.

4. The OLED display device of claim 1, wherein when the first transistor is turned on and the third transistor is turned off, an nth data voltage of a plurality of the data voltages is applied to the first node, and the voltage of the second node increases up to a difference voltage between the nth data voltage and an absolute threshold voltage of the second transistor.

5. The OLED display device of claim 1, wherein when the first and third transistors are turned off and a high-level source voltage is applied to the cathode, data voltages subsequent to an nth data voltage among a plurality of the data voltages are continuously applied to the source of the first transistor.

6. The OLED display device of claim 1, wherein a threshold voltage of the second transistor is equal to a threshold voltage of the driving transistor.

7. The OLED display device of claim 1, wherein the first and second scan signals are an nth scan signal and an n−1th scan signal of a plurality of scan signals, respectively.

8. A method of driving an organic light emitting diode (OLED) display device including a plurality of sub-pixels which each include first to third transistors, a driving transistor, a capacitor, and an OLED, wherein the first transistor is configured to receive a first scan signal and the third transistor is configured to receive a second scan signal, the method comprising:

dividing a frame period into a scan period and an emission period, wherein the scan period includes an initialization period, a sample period and a holding period:

sequentially supplying, during the scan period, to each of the plurality of sub-pixels, a high-level voltage for the first scan signal and a low-level voltage for the second scan signal during the initialization period, the low-level voltage for the first scan signal and the high-level voltage for the second scan signal during the sampling period, and the high-level voltage for the first scan signal and the high-level voltage for the second scan signal during the holding period;

initializing a voltage of a second node that is a second electrode of the second transistor according to a second scan signal applied to a gate of the third transistor, when the first transistor is turned off and the third transistor is turned on;

applying an nth data voltage of a plurality of data voltages to a first node that is a first electrode of the second transistor, and increasing the voltage of the second node up to a difference voltage between the nth data voltage and an absolute threshold voltage of the second transistor, when the first transistor is turned on and the third transistor is turned off; and emitting light when the first and third transistors are turned off and a low-level source voltage is applied to a cathode of the OLED in each of the plurality of sub-pixels, wherein, during the scan period, the OLED in each of the plurality of sub-pixels does not emit light, and wherein, during the emission period, the PLED in each of the plurality of sub-pixels simultaneously emits light.

9. The method of claim 8, wherein the initializing of a voltage comprises initializing the voltage of the second node to a sum of a low-level voltage of the second scan signal and an absolute threshold value of the third transistor.

10. The method of claim 8, further comprising continuously applying data voltages subsequent to an nth data voltage among a plurality of the data voltages to a source of the first transistor, when the first and third transistors are turned off and a high-level source voltage is applied to the cathode.

11. The method of claim 8, wherein, the first transistor is turned on by the first scan signal which is applied thereto through a first scan line, and the third transistor is turned on by the second scan signal which is applied thereto through a second scan line.

12. The method of claim 11, wherein the first and second scan signals are an nth scan signal and an n−1th scan signal of a plurality of scan signals, respectively.

13. The method of claim 8, wherein a threshold voltage of the second transistor is equal to a threshold voltage of the driving transistor.

* * * * *